United States Patent [19]

Niida et al.

[11] Patent Number: 4,823,750

[45] Date of Patent: Apr. 25, 1989

[54] AUTOMOTIVE ENGINE IDLE SPEED CONTROL DEVICE

[75] Inventors: Chiaki Niida; Tomoo Ito, both of Katsuta; Torazo Nishimiya, Mito; Takashi Iseyama, Ibaraki; Koichiro Yamada, Mito, all of Japan

[73] Assignees: Hitachi, Ltd.; Hitachi Automotive Engineering, both of Tokyo, Japan

[21] Appl. No.: 940,492

[22] Filed: Dec. 10, 1986

[30] Foreign Application Priority Data

Dec. 10, 1985 [JP] Japan ..... 60-277286
Apr. 18, 1986 [JP] Japan ..... 61-88009

[51] Int. Cl.[4] ..... F02M 3/12

[52] U.S. Cl. ..... 123/339; 123/587; 251/30.03

[58] Field of Search ..... 123/339, 587, 585; 251/30.03, 30.04, 38; 137/907

[56] References Cited

U.S. PATENT DOCUMENTS 2,694,544 11/1954 Hall ..... 251/38
3,030,981 4/1962 Chatham et al. ..... 251/30.03
3,512,749 5/1970 Noakes et al. ..... 251/30.03
4,355,606 10/1982 Casey ..... 123/339
4,356,802 11/1982 Kern et al. ..... 123/339

FOREIGN PATENT DOCUMENTS 0133445 2/1985 European Pat. Off. .
2940237 4/1981 Fed. Rep. of Germany .
3513036 10/1985 Fed. Rep. of Germany .
433729 8/1935 United Kingdom ..... 251/30.03
2035453 6/1980 United Kingdom .
2066930 7/1981 United Kingdom .
2085522 4/1982 United Kingdom .

*Primary Examiner*—Andrew M. Dolinar
*Attorney, Agent, or Firm*—Antonelli, Terry & Wands

[57] ABSTRACT

Automotive engine idle speed control device meters the flow rate of air supplied to the engine bypassing an intake pipe thereof during engine idle operation to thereby control the engine idle speed. An actuating vacuum is produced in accordance with an electrical signal and acts on a diaphragm fixed to a valve movable with the diaphragm to meter the bypass air flow. To cancel any external force acting on the valve, adjusting means is provided to control the vacuum on the diaphragm independently of the electrical signal to displace the diaphragm in a direction opposite to the direction of action of the external force on the valve.

5 Claims, 4 Drawing Sheets

AUTOMOTIVE ENGINE IDLE SPEED CONTROL DEVICE

BACKGROUND OF THE INVENTION

1. Field of the Invention

The present invention relates to a device for automatically controlling the idle speed of an automotive engine in response to changes in engine operating conditions, such as the engine cooling water temperature, the ambient air temperature and so forth, to maintain the idle speed at a predetermined set level regardless of such changes in the engine operating conditions. More particularly, the invention is concerned with an electronically controllable actuator suitable for use in such engine idle speed control devices.

2. Description of the Prior Art

Japanese Patent Pre-Examination Publication No. 116966/1981 discloses an engine idle speed control device operative to control the rate of air flow through a bypass air passage extending in bypassing relationship to a throttle valve in an intake pipe of the engine. More specifically, this device employs a pair of bypass air metering valves arranged such that vacuum forces act on the valves in opposite directions to eliminate any influence by the vacuum force which would otherwise adversely affect the air metering characteristics in the case where only one such valve is used.

In the known engine idle speed control device, the condition of balance between the forces acting on the air metering valves was liable to be changed due to a change in the bypass air flow rate, depending on factors such as the shape of the bypass air passage, the shapes of the air metering valves and so forth. Thus, it was difficult to obtain a valve displacement which is exactly proportional to a supply of electric current to a solenoid section of the device.

SUMMARY OF THE INVENTION

Accordingly, it is an object of the present invention to provide an automotive engine idle speed control device capable of providing a valve displacement which is substantially exactly proportional to the level of a supply of electric current to a solenoid section of the device.

This object is attained by providing a vacuum actuated diaphragm displaceable in response to an electrical signal to the solenoid section of the device to move a valve relative to a valve seat to thereby control the air-flowing area of the bypass air passage, and also by providing a compensation means operative to control the vacuum force on the diaphragm in such a manner as to cancel external forces on the valve independently of the electric signal supply to the solenoid section of the device.

By this feature of the invention, the external forces acting on the valve can automatically be cancelled to assure that the rate of bypass air flow is precisely related to the electric signal supply to the solenoid section of the device.

DESCRIPTION OF THE PREFERRED EMBODIMENTS

The basic construction and operation of a first embodiment will be described hereinunder with reference to the drawings.

The idle speed control device includes a valve which is disposed in a bypass air passage extending in bypassing relationship to an intake pipe of an automotive internal combustion engine. The valve is provided with a central communication passage formed therein and extending therethrough. A plunger is disposed in a solenoid coil and is provided on an end thereof with a closure member which is disposed in opposite relationship to one open end of the communication passage in the valve so as to open and close the communication passage depending on the displacement of the plunger. The communication passage extends through a diaphragm so that the other end of the communication passage opens into a diaphragm chamber defined partly by the diaphragm. When the closure member opens the communication passage, the diaphragm chamber is supplied with atmospheric pressure through the communication passage. The diaphragm chamber is also adapted to be supplied with engine intake vacuum through an orifice.

The plunger is displaceable in response to an electric input to the solenoid to cause the closure member to block the communication passage, so that the engine intake vacuum is fed into the diaphragm chamber. In consequence, the pressures on the opposite sides of the diaphragm become equal, so that the valve is moved away from a valve seat by a pressure difference across the valve. Then, the communication passage in the valve is again opened. The movement of the valve is followed by a movement of the plunger. The described steps of operation are repeated until the valve reaches a position which corresponds to the electric input to the solenoid whereby the bypass air flows through the bypass air passage at a rate corresponding to the electric input to the solenoid of the device.

In order that the present invention may be easily understood, the construction and operation of a known device will be described hereinunder in advance of description of preferred embodiments of the invention.

Figure 4:
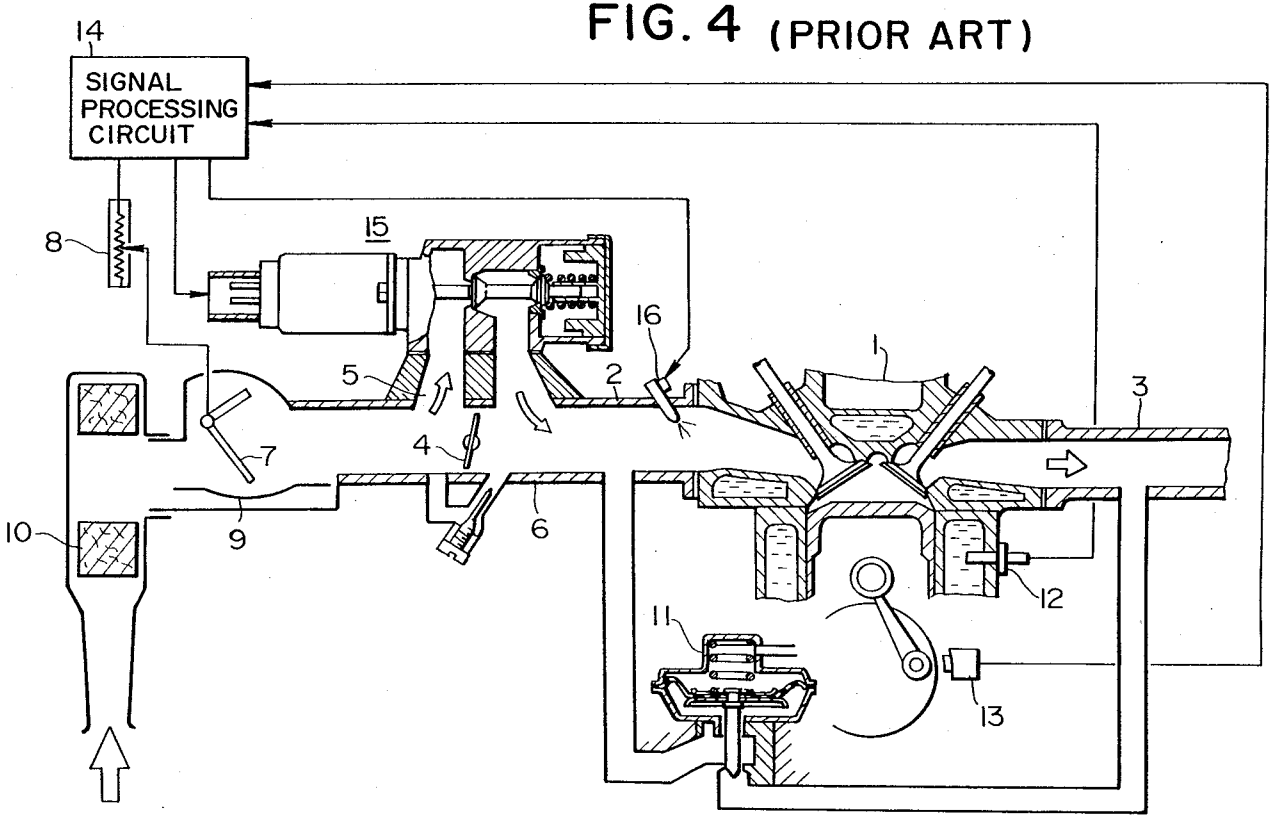
FIG. 4 (PRIOR ART)
FIG. 4 is an illustration of a control system of an automotive internal combustion engine to which the idle speed control device of the invention is applied.

Referring to FIG. 4, an automotive internal combustion engine 1 has an intake pipe 2 and an exhaust pipe 3. The intake pipe 2 includes a throttle valve chamber 6 which accommodates a throttle valve 4. A bypass air passage 5 is formed in the throttle valve chamber 6 and extends in bypassing relationship to the throttle valve 4. An air flow meter 9 is disposed upstream of the throttle valve chamber 6 and includes a vane 7 adapted to be rotated in accordance with the flow rate of the air and a potentiometer 8 for converting the angle of rotation of the vane into an electric signal. An air cleaner 10 is disposed on the upstream side of the air flow meter 9. An EGR (Exhaust Gas Recirculating) valve 11 is disposed in an EGR passage which is connected between a portion of the exhaust pipe 3 and a portion of the intake pipe 2 so as to permit a part of the exhaust gas to be recirculated back into the intake pipe 2 of the engine in a controlled manner. This EGR valve, however, does not constitute any part of the invention.

When the throttle valve 4 is in a substantially closed idle position, engine intake air flows through the bypass passage with the pressure thereof pulsated in accordance with the rotation of the engine.

The engine has various sensors such as a water temperature sensor 12 for measuring the temperature of cooling water circulated through the engine 1, a crank angle sensor 13 for measuring the rotation speed of the engine crankshaft, and so forth. These sensors produce electric signals corresponding to the measured values and deliver these signals to a processing circuit 14 incorporating therein a microcomputer which suitably processes these signals and produces control signals to be delivered to various devices and parts, such as an idle speed control device 15 and fuel injectors 16. The processing circuit 14 constitutes a major section of an electronic engine control system. The idle speed control device of the invention, to be described, is also under the control of the processing circuit 14.

The idle speed control device 15 is disposed in the bypass passage 5 of the throttle valve chamber 6 and is adapted to control the rate of air flowing through the bypass passage 5.

Figure 2:
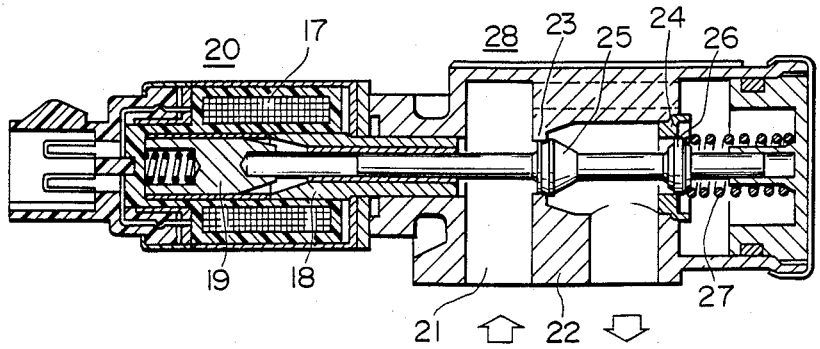
FIG. 2 (PRIOR ART)
FIG. 2 is a longitudinal sectional view of a known idle speed control device.
Figure 3:
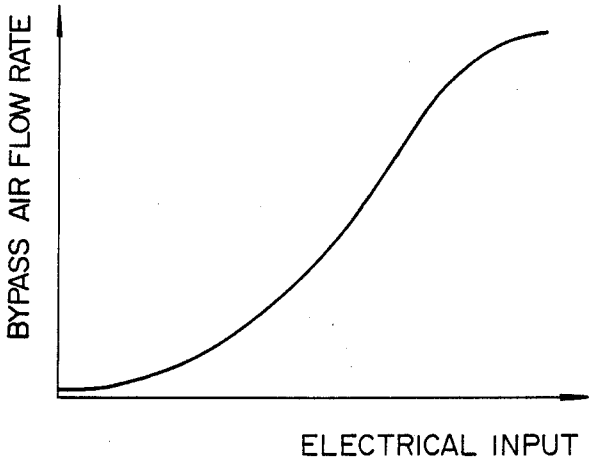
FIG. 3 (PRIOR ART)
FIG. 3 is a diagram showing the flow-rate characteristics of the known idle speed control device shown in FIG. 2.

FIG. 2 shows the construction of a conventional idle speed control device 15. The idle speed control device has a solenoid portion 20 for converting an electric input signal supplied to a cylindrical coil 17 to a mechanical displacement and a flow-rate control mechanism portion 28 for controlling the flow rate of the bypass air in response to the mechanical displacement. More specifically, the solenoid portion 20 has a core 18 and a plunger 19 which are coaxially received in the cylindrical coil 17. The end surface of the plunger 19 adjacent to the core 18 is conically tapered towards the core 18, while the end surface of the core 18 adjacent to the plunger 19 is conically recessed. The flow-rate control mechanism portion 28 includes a body 22 formed therein with a passage 21 for air or a fluid to be controlled, a pair of valve seats 23 and 24 which are provided at intermediate portions of the passage 21, a spool valve having a pair of valve portions 25 and 26, and a spring 27. As stated before, signals from the sensors, such as the cooling water temperature sensor 12 and the crank angle sensor 13 are delivered to the processing circuit 14 which processes these signals to produce control output signals. Upon receipt of one of these control output signals from the processing circuit 14, the idle speed control device 15 operates to control the rate of bypass air flow to maintain the engine idle speed at a predetermined desired value.

Figure 5:
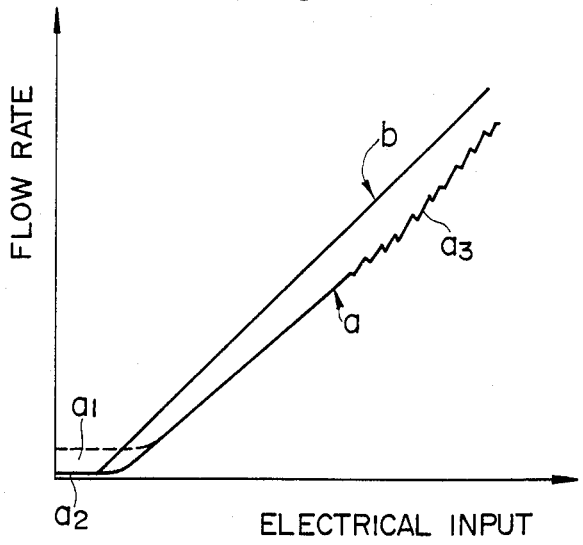
FIG. 5 is a chart showing the flow-rate characteristics of the first embodiment.

Thus, the function of the idle speed control device 15 is to automatically and continuously maintain the idle speed of the engine at a predetermined set idle speed, based upon signals produced by the cooling water temperature and the engine speed. The pair of valve seats 23 and 24 and the pair of valve portions 25 and 26 cooperate to form an air metering section. The design is such that the vacuum forces of the same level act on both valve portions 25 and 26 in opposite directions so as to cancel each other. However, if too much importance is given to the cancellation of the vacuum forces, the linearity of the output characteristics of the idle speed control device 15 will be impaired, as shown in FIG. 5. It is true that this non-linearity does not cause any substantial disadvantage because the engine speed control can incorporate a suitable feedback control. This known idle speed control device, however, has only a small adaptability to a variety of types of engines which require different air metering characteristics. Namely, in order to make this idle speed control device adaptable to different types of engines, it takes a long time to obtain practical designs which provide different air metering characteristics suited to those different types of engines. This problem is serious considering the fact that there is an increasing demand for a variety of types of engines.

Under these circumstances, the present invention aims at providing an idle speed control device which can eliminate the above-described problems of the prior art.

A preferred embodiment of the present invention will be described hereinunder with specific reference to FIGS. 1 and 5, in which the same reference numerals are used to denote the parts the same as or equivalent to those of the known device explained hereinabove.

Figure 1:
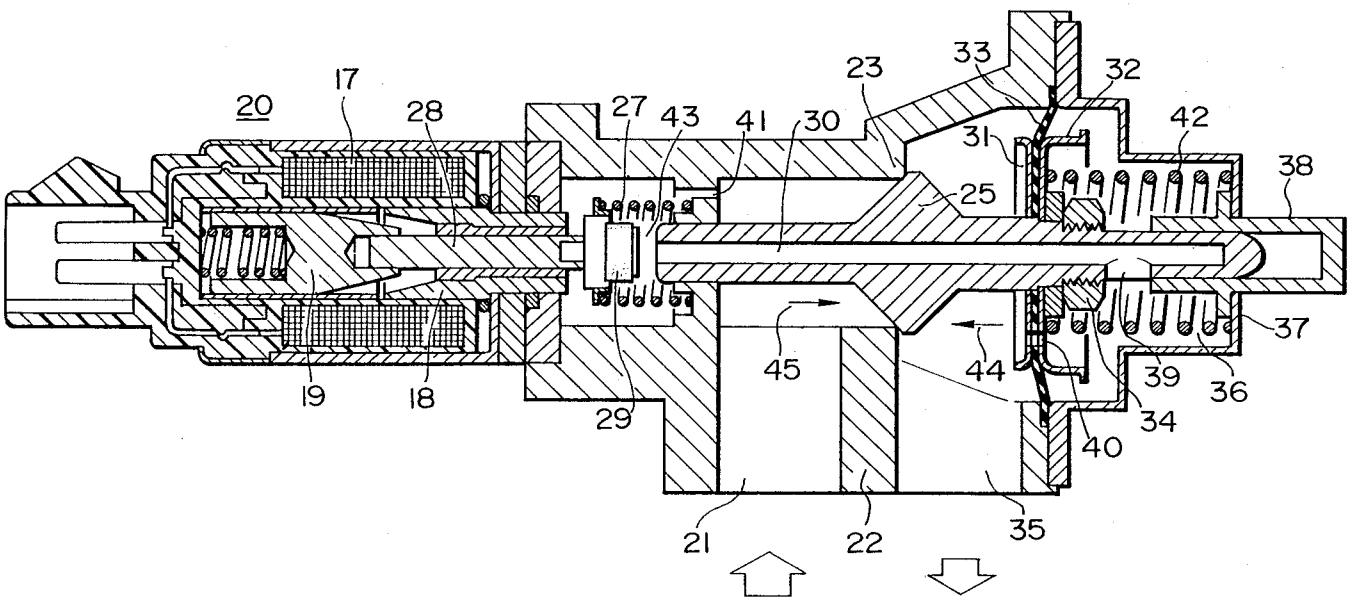
FIG. 1 is a longitudinal sectional view of a first embodiment of an idle speed control device in accordance with the present invention.

Referring to FIG. 1, a first embodiment of the idle speed control device in accordance with the present invention has a closure member 29 made of an elastic material such as rubber and attached to the end of a rod 28 which in turn is fixed to one end of a plunger 19. The closure member 29 is disposed to face an adjacent end of a valve member 25 so that it can make contact with the adjacent end of the valve member 25. A compression spring 27 extends between the closure member 29 and the body 22. The arrangement is such that the closure member 29 is moved with the plunger to a position where balance is obtained between the force produced by the spring 27 and the electromagnetic force produced by the solenoid portion 20.

The valve member 25 has an axial bore which constitutes a pressure communication passage 30. A diaphragm 33 is fixed to a part of the valve member 25 remote from the closure member 29 by means of a pair of diaphragm retainers 31 and 32 which are tightened by a nut 34. The diaphragm 33 partly defines a diaphragm chamber 36 which is separated from a vacuum passage 35. The end of the valve member 25 remote from the closure member 29 extends through the diaphragm 33 into the diaphragm chamber 36 and is slidably supported by a support 38 provided on a cover 37 which cooperates with the diaphragm 33 to define the diaphragm chamber 36.

An orifice 39 is formed in the wall of the valve member 25 to provide communication between the passage 30 and the diaphragm chamber 36. More specifically, the arrangement is such that the orifice 39 overlaps an inwardly projected wall of the support 38 as the valve member 25 slides to the right and left as viewed in FIG. 1, so that the area of the orifice 39 is varied depending on the position of the valve member 25 relative to the support 38. The diaphragm 33 is formed therein with an orifice 40 which provides communication between the diaphragm chamber 36 and the vacuum passage 35. The parts mentioned above cooperate to form an air metering mechanism section. A vent hole 41 is formed in a wall of the body 22 which slidably supports the end of the valve member 25, adjacent to the closure member 29. A compression spring 42 extends between the cover 37 and the diaphragm retainer 32 to produce a force for returning the diaphragm 33.

In operation, when a vacuum of a predetermined level is applied to the vacuum passage 35 while no electrical input is given to the solenoid 20, the plunger 19 is held in its inoperative position shown in FIG. 1 in which the closure member 29 and the valve member 25 are spaced from each other to define a gap 43 therebetween. In this position, therefore, atmospheric pressure is introduced from the passage 21 into the diaphragm chamber 36 through the vent hole 41, gap 43, passage 30 and the orifice 39, so that a predetermined pressure difference is established across the diaphragm 33. The pressure difference produces a force which acts on the diaphragm 33 in the direction of an arrow 44 so that the diaphragm 33 is deflected to cause the valve member 25 to be moved in the direction of the arrow 44 until the valve member 25 is seated on the valve seat 23.

If a predetermined electrical input of, for example, 3A is supplied to the solenoid 20, the plunger 19, rod 28 and closure member 29 are moved as a unit against the spring 27, so that the closure member 29 is brought into contact with the adjacent end of the valve member 25 to close the passage 30 thereby terminating the introduction of the atmospheric pressure into the diaphragm chamber 36. As a result, the pressure in the diaphragm chamber 36 is reduced and, after the elapse of a predetermined time, becomes to be the same level as the vacuum in the vacuum passage 35, so that the pressure differential across the diaphragm 33 becomes zero. In consequence, the force acting in the direction of the arrow 44 is nullified so that the valve member 25 is instantaneously moved in the direction of an arrow 45.

As a result, the valve member 25 is spaced from the closure member 29 to again form the gap 43 so as to allow the atmospheric pressure to be introduced into the diaphragm chamber 36 through the passage 30 and the orifice 39, thus recovering the atmospheric pressure in the diaphragm chamber 36. In consequence, a force is generated again to deflect the diaphragm 33 in the direction of the arrow 44, tending to move the valve member 25 again towards the closure member 29.

This operation is repeated until the closure member 29 movable with the plunger 28 reaches a position which is proportional to the electrical input supplied to the solenoid 20. However, the amount of stroking of the closure member 29 in each cycle of the repetitional operation is progressively decreased as the closure member 29 approaches the position proportional to the electrical input. Finally, the clearance between the valve member 25 and the valve seat 23 and, hence, the rate of the air flowing through the gap between the valve member 25 and the valve seat 23 are set at levels corresponding to the level of the electrical input supplied to the solenoid 20.

As will be understood from the foregoing description, in the described embodiment, the solenoid 20 effects a conversion of an electric signal into mechanical displacement or position with a good linearity and the bypass air is metered in accordance with the change in the position. The force which drives the valve member 25 is derived from the pressure differential developed on the valve member 25 itself and, in addition, any change in the pressure differential is compensated for by a compensation mechanism constituted by the diaphragm.

A description will be made hereinunder as to the effect of variable orifice 39. The size or the area of the variable orifice 39 is influential when the closure member 29 and the valve member 25 are spaced from each other, i.e., when the gap 43 is formed therebetween. By designing the orifice 39 so that it has a large area, it is possible to obtain a large force acting on the diaphragm 33 in the direction of the arrow 44 and, therefore, to keep the valve member 25 in sealing engagement with the valve seat 23 when there is no electrical input to the solenoid, thus minimizing the initial leak of the air, i.e., rate of leak of air which inevitably occurs when the valve member 25 is seated on the valve seat 23. In FIG. 5, the rate of the initial leak experienced in the known idle speed control device is shown at $a_1$, while $a_2$ indicates the rate of initial leak in the described embodiment of the idle speed control device. The large area of the orifice 39, however, causes the following problem. Namely, when an electrical input of a high level is supplied to effect on-off control by the movement of the closure member 29 relative to the valve member 25, the force acting on the diaphragm 33 in the direction of the arrow 44 is correspondingly large, so that the rate of the air flow to be controlled by the displacement of the valve member 25 is increased to cause a hunting of the control as shown by a portion $a_3$ of the curve a shown in FIG. 5, possibly resulting in a control failure.

From these facts, it will be understood that the area of the orifice 39 is preferably varied progressively in accordance with the stroking of the valve member 25.

In the described embodiment of the invention, therefore, the area of the orifice 39 is progressively changed by the inwardly projecting wall of the support 38 as the valve member 25 is moved. With this arrangement, it is possible to obtain flow rate characteristics with good linearity and reduced initial leak. In addition to this fundamental effect, the idle speed control device of the invention provides an advantage that the compensation force produced by the diaphragm is varied by the variable orifice 39 in accordance with the change in the level of the electrical input, thus assuring a high linearity of the flow rate characteristics over a wide area of the air flow rate while minimizing the initial leak.

Figure 6:
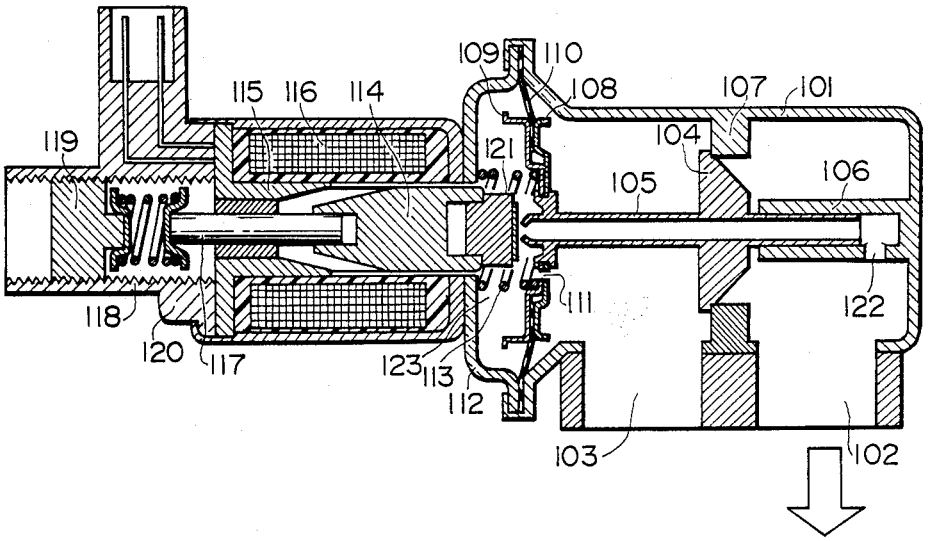
FIG. 6 is a longitudinal sectional view of a second embodiment of the idle speed control device in accordance with the present invention.

A second embodiment of the idle speed control device in accordance with the present invention will be described hereinunder with specific reference to FIG. 6.

This embodiment has a casing 101 having a vacuum passage 102 communicating with the portion of the intake pipe downstream of the throttle valve and a passage 103 communicating with a portion of the intake pipe upstream of the throttle valve. A valve member 104 is carried by a stem 105 which is axially slidably supported in a cylindrical support 106 formed integrally on the casing 101. An orifice 122 is formed in the cylindrical support 106 in communication with the vacuum passage 102. The valve member 104 is adapted to be brought into contact with a valve seat 107 fixed to the casing 101, so as to completely seal the passages 102 and 103 from each other. A diaphragm 110 is clamped at an inner peripheral edge between diaphragm retainer plates 108 and 109 which are fixed to the stem 105. A vent orifice 111 is formed in the diaphragm 110 and the diaphragm retainer plates 108 and 109 so as to provide communication between the passage 103 and a space 123 defined by the diaphragm 110 and a cover 112. The outer peripheral edge of the diaphragm 110 is clamped between the casing 101 and the cover 112. A compression spring 113 extends between the diaphragm retainer plate 109 and the cover 112. A solenoid unit is fixed to the cover 112. The solenoid unit includes a plunger 114 movable in the direction of axis of the valve stem 105, a core 115 for electromagnetically attracting the plunger 114, a coil 116 surrounding the core 115 and the plunger 114, a rod 117 fixed to the plunger 114, a spring 118 for urging the shaft 117, an adjusting screw 119 for adjusting the force of the spring 118, and a molded housing member 120 which accommodates the component parts mentioned above. A closure member 121 is fixed to the end of the plunger 114 adjacent to the diaphragm 110. This solenoid unit is designed to have linear operation characteristics so that it produces mechanical displacement which linearly changes in response to a change in the electrical input signal supplied to the coil 116 of the solenoid unit.

Thus, the plunger 114 moves towards the solenoid as the level of the input electrical signal is increased. This causes the closure member 121 to be moved in the same direction as the plunger 114, i.e., away from the end of the valve stem 105. In consequence, a vacuum is introduced from the passage 102 into the space 123 through the orifice 122 and the passage formed in the stem 105. Although atmospheric air flows through the orifice 111 into the chamber 123, a vacuum is established and maintained in the space 123 because the rate of the air flow through the orifice 122 is higher. In consequence, a pressure differential is produced between the passage 103 and the space 123 across the diaphragm 110, so that the diaphragm 110 is deflected to the left as viewed in FIG. 6 thereby causing the valve member 104 to leave the valve seat 107. Thus, the stem 105 is moved into close contact with the closure member 121 in accordance with the balance between the vacuum introduced through the gap between the stem 105 and the closure member 121 and the atmospheric pressure leaking into the space 123 through the vent orifice 111.

The spring 113 is intended to prevent of the closure member 121 from being moved by vibration or the like. Any fluctuation in the spring 113, which may have been incurred in the course of production, can be compensated for by an adjustment by means of the adjusting screw 119 provided on the outer end of the solenoid unit.

It will be seen that the valve member 104 is always held in contact with the valve seat 107 whenever the solenoid coil is not electrically energized. The valve member 104 can be seated on the valve seat 107 even when the diaphragm 110 has been accidentally broken. In the event of a clogging of the vent orifice 111, the valve member 104 is not moved away from the valve seat 107 unless the closure member 121 is moved out of contact with the valve stem 105. Thus, the second embodiment provides a fail-safe function which keeps the valve member 104 in the closed position in the event of an accident or failure in the idle speed control device.

As will be understood from the foregoing description, the present invention provides the following advantages:

Since the electromagnetic force produced by the solenoid is used only for the purpose of pressure control, it is possible to make an effective use of the linearity, which is inherently possessed by a solenoid, to obtain a good linearity of the output characteristics.

In addition, the flow rate or metering characteristic is determined solely by the profile of the valve member partly because the valve member is actuated only by the pressure difference developed thereon and partly because the valve-driving force is compensated by the diaphragm which in turn operates due to the pressure difference produced thereacross in response to the displacement of the valve member. This in turn assures that the idle speed control device can be adapted to a variety of types of engines which may require different flow rate or metering characteristics.

What is claimed is:

1. An idle speed control device for an automotive engine of a type that includes an intake pipe and a bypass air passage extending in bypassing relationship to a throttle valve in said intake pipe so that, when said throttle valve is in a substantially closed idle position, air flows through said bypass air passage with a pressure thereof pulsated in accordance with the engine rotation, said device including a solenoid, a plunger movable by said solenoid, and a valve means operative to control the rate of the air flow through said bypass air passage in accordance with a displacement of said plunger, wherein:

said valve means has a valve stem which is formed therein with a communication passage;

a casing for said device, said casing including a support formed integrally on said casing, one end of said valve stem being slidably supported in said support, and said support having an orifice formed therein in communication with said communication passage of the valve stem;

a diaphragm is disposed on an air inlet side of said bypass air passage and fixed to said valve stem;

a vacuum chamber is defined between said diaphragm and a casing enclosing said diaphragm, said vacuum chamber being supplied with vacuum from an air outlet side of said bypass air passage through said communication passage in said valve stem;

said vacuum chamber being provided with a vacuum-leak passage formed between said vacuum chamber and said air inlet side of said bypass air passage;

a closure member is provided on an end of said plunger in opposite relationship to an end of said communication passage in said valve stem to cooperate therewith to control the supply of vacuum into said vacuum chamber; and said closure member and said valve stem are separated when said valve means is moved in a valve-closing direction due to an increase in the vacuum in said intake pipe, to cause engine intake vacuum to be fed into said vacuum chamber whereby the diaphragm moves said valve means in a valve-opening direction.

2. An engine idle speed control device according to claim 1, wherein said vacuum-leak passage is formed in said diaphragm.

3. An engine idle speed control device according to claim 1, wherein a spring means is disposed in said vacuum chamber between said casing and said diaphragm so that said diaphragm is biased by said spring means in a valve-closing direction.

4. An engine idle speed control device according to claim 1, wherein said solenoid includes a spring acting on said plunger and a mechanism for adjusting the force of said spring.

5. An engine idle speed control device according to claim 1, wherein said diaphragm is fixed to the other end of said valve stem.

* * * * *